US008403024B2

(12) United States Patent
Laudenklos

(10) Patent No.: US 8,403,024 B2
(45) Date of Patent: Mar. 26, 2013

(54) FORM RELEASE LAYER FOR THE CASTING NONFERROUS METALS

(75) Inventor: Manfred Laudenklos, Schoeneck (DE)

(73) Assignees: KS Aluminium-Technologie GmbH, Neckarsulm (DE); Gelita AG, Eberbach (DE)

( * ) Notice: Subject to any disclaimer, the term of this patent is extended or adjusted under 35 U.S.C. 154(b) by 272 days.

(21) Appl. No.: 12/205,311

(22) Filed: Sep. 5, 2008

(65) Prior Publication Data

US 2009/0050288 A1 Feb. 26, 2009

Related U.S. Application Data

(63) Continuation of application No. PCT/EP2007/001300, filed on Feb. 15, 2007.

(30) Foreign Application Priority Data

Mar. 7, 2006 (DE) ..... 10 2006 010 876

(51) Int. Cl.
*B22C 3/00* (2006.01)
*B28B 7/36* (2006.01)
*B29C 33/56* (2006.01)

(52) U.S. Cl. ..... 164/14; 106/38.2; 106/38.22; 427/135; 249/114.1; 249/115

(58) Field of Classification Search ..... None
See application file for complete search history.

(56) References Cited

U.S. PATENT DOCUMENTS

| | | | | |
|---|---|---|---|---|
| 3,727,666 | A * | 4/1973 | Vander Sluis | 164/72 |
| 3,770,465 | A | 11/1973 | Howells | |
| 4,454,050 | A * | 6/1984 | Bertell | 508/219 |
| 5,452,755 | A | 9/1995 | Morikawa et al. | |
| 6,051,058 | A | 4/2000 | Crisci et al. | |
| 2002/0189780 | A1 | 12/2002 | Gunkel et al. | |
| 2002/0192511 | A1 | 12/2002 | Hruschka et al. | |
| 2005/0043189 | A1 * | 2/2005 | Stewart et al. | 508/112 |
| 2006/0159909 | A1 * | 7/2006 | Aslan et al. | 428/323 |

FOREIGN PATENT DOCUMENTS

| | | | |
|---|---|---|---|
| DE | 1 433 969 | A | 2/1969 |
| DE | 198 42 660 | A1 | 3/2000 |
| DE | 101 24 434 | A1 | 11/2002 |

* cited by examiner

*Primary Examiner* — Kevin P Kerns
*Assistant Examiner* — Steven Ha
(74) *Attorney, Agent, or Firm* — Muncy, Geissler, Olds & Lowe, PLLC

(57) ABSTRACT

A metallic, ferriferous permanent mold, especially a permanent steel mold, is provided that can be impinged upon with a liquid or flowable aluminum material, a layer for protecting the permanent form and for obtaining an optimum cast result being producible by means of a mold release agent. The invention also relates to a mold release agent for producing said layer and to a method for producing said layer.

5 Claims, No Drawings

FORM RELEASE LAYER FOR THE CASTING NONFERROUS METALS

This nonprovisional application is a continuation of International Application No. PCT/EP2007/001300, which was filed on Feb. 15, 2007, and which claims priority to German Patent Application No. DE102006010876.0, which was filed in Germany on Mar. 7, 2006, and which are both herein incorporated by reference.

BACKGROUND OF THE INVENTION

1. Field of the Invention

The invention relates to a metallic, iron-containing permanent mold with a coating, which can be exposed to a liquid or free-flowing aluminum material. In addition, the invention relates to a mold release agent for preparing a layer of this type, and a method for producing a layer of this type on a surface of a permanent mold.

2. Description of the Background Art

Due to the extremely high corrosion, which current metallic materials exhibit at typical processing temperatures in comparison with aluminum and other nonferrous metals, contact sites between the nonferrous metals and the permanent form must be treated with so-called mold release agents, so that failure-free operation is possible. Particularly but not exclusively in pressure casting processes, which are characterized by the use of high temperatures and pressures, highly different requirements, set forth hereinafter, are imposed on the mold release agents used thereby. Thus, the mold release agent must be used to support the metal flow, which leads to uniform filling of the permanent mold and, at the same time, the mold release agent is used to improve the final ductility of the cast parts. In addition, the mold release agent is used to avoid residues on the permanent mold, which can lead to imprecision in the mold. During the casting of the material in the permanent form, excess gas formation may not occur during the disintegration of the mold release agent, which would result in porosity of the molded parts. The mold release agent finally may also not contain any hazardous or toxic substances. The quality of the mold release agent is assessed depending on the meeting of these requirements.

A material known and used in mold release agents is boron nitrite (BN), which is similar to graphite in its crystal structure. Like graphite, it has a low wettability for many substances, such as, for example, silicate melts or metal melts. For this reason, there are many studies on nonadherent layers based on boron nitrite to utilize them for casting processes. The problem in the case of this utilization, however, is that permanent application of boron nitrate in bulk onto molds, particularly of a complex nature, does not succeed. A method for the permanent application of a temperature-stable, corrosion-resistant mold release layer is described in German Patent Application No. DE 198 42 660 A1. In this case, a boron nitrite powder is applied to the surface of a permanent mold using electrostatic coating.

Attempts were also made to produce binding agents on an inorganic base into which boron nitrite is integrated. The production of boron nitrite protective layers with thicknesses of 0.2 to 0.7 mm on refractory materials for the continuous casting of steel is described in U.S. Pat. No. 6,051,058. In this case, boron nitrite is bound to the refractory material on the order of 20 to 50% by weight with use of high temperature binders in the form of an aqueous coating solution based on metal oxides from the group including $ZrO_2$, zirconium silicates, as $Al_2O_3$, $SiO_2$, or aluminum phosphates.

To suppress wear and the corrosion of materials, a wear protection layer, into which functional materials are integrated in a binder matrix, is known from German Patent Application No. DE 101 24 434 A1, which corresponds to U.S. Publication No. 20020192511. This so-called functional coating having an inorganic matrix phase, including at least largely of a phosphate, and a functional material, which is embedded therein and may be, for example, a metal, graphite, a hard material, a dry lubricant, an aluminum oxide, a silicon carbide, etc. A method for producing this functional coating is also described, whereby a functional material in powder form is dissolved in a liquid component, which may be, for example, water, and combined with phosphoric acid to generate a phosphate. A matrix solution, made up in such a way, with the liquid component and the phosphate can also be called a gel because of its consistency. After a material is coated with this matrix solution, the material is subjected to heat treatment, so that an adherent functional coating forms on the base material.

SUMMARY OF THE INVENTION

It is therefore an object of the present invention is to develop a long-term stable layer on a metallic, iron-containing permanent mold, which bonds chemically with the base material of the permanent mold and thereby satisfies the requirements for a mold release agent or even exceeds these requirements. Moreover, the object of the invention is to provide a mold release agent for preparing a layer of this type, which is economical to produce and simple to apply without apparatus-related expenditure. Another object of the invention is to provide a method which is capable of producing such a layer and by means of which damage to the layer can be easily healed.

DETAILED DESCRIPTION

In an exemplary embodiment, in regard to a coating on the permanent mold to the effect that on at least one surface of the permanent mold, there is a layer including iron fluoride bound chemically to a base material of the permanent mold, structural parts in the form of Al2O3 and/or SiO2 and/or TiO2 and/or ZrO2 in a size of 80 nm to 200 nm, and a polymer of polymerized zirconium fluoride, surrounding the structural parts at least partially.

In an embodiment of the invention, the layer can contain in addition: primary parts in the form of Al2O3, SiO2, TiO2, ZnO, ZrO2, and CeO2 in a size of 2 nm to 80 nm, and/or sliding parts in the form of boron nitrite in a size of 2 μm to 15 μm, and/or mica as the silicate mineral.

The requirements for a mold release agent in the form of a long-term stable layer are especially well met by the layer of the invention on the metallic permanent mold. Thus, the metal flow is supported by the effect that the oxide skin of the aluminum material is broken up by the structural parts protruding from the layer and the liquid aluminum material below the oxide layer can be distributed very easily in the permanent mold. The layer thus offers optimal conditions for filling of the permanent mold. The sliding parts in the form of boron nitrite (BN) function as a sliding plane for the liquid or free-flowing aluminum and thereby support the metal flow; they are used moreover simultaneously to improve the final ductility of the cast components.

An adherent layer forms on the surface of the permanent mold, whereby the solid bond is produced by the chemical binding of the fluorides with the iron of the base material of the permanent mold. The use of this type of solid binding of the layer with the base material of the permanent mold avoids residues from adhering to the permanent mold which could result in size inaccuracies. Another advantage of the layer of the invention is that the layer is stimulated to increased polymerization at higher temperatures. Longer polymers form as a result, which, on the one hand, increase adhesion and cohesion and, on the other, the elasticity of the layer. The long-term stable and adherent layer is thereby extremely elastic at higher temperatures, as they occur during filling of the permanent mold, and can follow the changes in the form of the permanent mold elastically and thereby in an advantageous manner without damage to the layer.

In regard to the mold release agent, the object of the invention is attained to the effect that the mold release agent is formed completely of deionized water and contains the following components: an acidifier in the form of sodium hydroxide solution and/or potassium hydroxide solution and/or aluminum chloride, a binder of zirconium fluoride, an amount of the binder being less than or equal to 5% by weight, preferably in the form of $H_2ZrF_6$, an amount of structural parts in the form of $Al_2O_3$ and/or $SiO_2$ and/or $TiO_2$ in a size of 80 nm to 200 nm, and an organic dispersant, preferably gelatin.

In an embodiment of the invention, the mold release agent contains in addition: an amount of primary parts in the form of $Al_2O_3$, $SiO_2$, $TiO_2$, ZnO, $ZrO_2$, and CeO in a size of 1 nm to 10 nm and/or an amount of sliding parts in the form of BN and/or magnesium aluminum silicate and/or molybdenum disulfide in a size of 2 μm to 15 μm and/or mica.

The separating agent of the invention offers the advantage, on the one hand, that it can be produced economically on the basis of deionized water and, on the other, is simple to apply to the tool due to its viscosity. In the simplest case, the mold release agent can be sprayed onto the permanent mold. Moreover, the mold release agent meets the requirements for a mold release agent to the effect that no toxic substances are present that can be disposed of only at high cost.

The object of the invention object is attained in regard to the method for creating a layer to the effect that the surface is first provided with the mold release agent according to any one of claims 6 through 13 and that the permanent mold is then heated to a temperature of at least 200° C. As a result of this heating, the fluoride bonds chemically with the iron of the base material and the zirconium fluoride forms polymers that create an adherent layer on the surface of the permanent mold. It is advantageous in this case that the mold release agent, which includes completely deionized water, is already completely evaporated from the layer at this temperature and therefore no or only very minor gas formation occurs during the filling of the permanent mold. In addition, the polymerization is supported further during an increase in temperature so that, as described above, another advantageous effect of the layer is produced. The use of gelatin is especially advantageous in this case, because nanoparticles are formed independently as a result.

Moreover, if damage to the layer occurs, the layer can be healed very easily, because it is possible to heal defects in the layer directly after a repeated application of the mold release agent to the permanent mold. In this case, new iron fluoride is formed and the zirconium fluoride is polymerized by the temperature of the permanent mold, so that the layer heals completely.

A layer is formed on the surface, which is naturally preferably the side of the permanent mold corresponding to the cast part to be produced; said layer has a thickness of about 1 to 80 μm; preferably the layer thicknesses are between 30 and 50 μm, which in turn depends on the case of application. The layer thickness depends on the case of application, i.e., the casting method, the thinnest layers being used with pressure casting and the thickest at low pressure. The thinnest layers are applied during pressure casting, because here good heat transfer to the permanent mold is intentionally produced to enable rapid solidification of the cast part. An average thickness is established in the combined so-called squeeze casting method, because here the casting mold is filled slowly and then exposed to a high pressure. Therefore, a lower heat transfer to the permanent mold is beneficial. In pressureless casting, on the contrary, thick layers are advantageous, because here the mold is filled relatively slowly and slow cooling of the cast part is advantageous. In addition, the permanent mold of the invention provided with a coating naturally can also be used for gravity casting.

The layer present on the surface of the permanent mold is bound chemically by the iron fluoride to the base material. The iron fluoride thus acts as an adhesive between the layer and base material. The structural parts in the form of $Al_2O_3$ and/or $SiO_2$ and/or $TiO_2$ and/or $ZrO_2$ are about 80 nm to 200 nm in size, catch one against another, and form a layer on the base material. In this case, the term structural parts is selected specifically, because preferably particles are used that are not smooth but have a structured surface. The primary parts in the form of $Al_2O_3$ and/or $SiO_2$ and/or zinc oxide and/or titanium dioxide and/or zirconium oxide and/or cerium oxide, which are present in the size of 1 nm to 10 nm, are incorporated preferably and very easily in the gaps between the structural parts. In an embodiment, the amount of primary parts are present in an amount less than or equal to 3% by weight. In another embodiment, the amount of primary parts are present in an amount between 1% by weight and 3% by weight. The very much larger sliding parts of boron nitrite lie between the structural parts in the layer and are held by the bonding of the structural parts with polymers. The thus formed layer already due to its fractile structure has an interlocking action, but the substantial bond between the iron fluoride and the structural parts, the primary parts, and the sliding parts is created by the polymerized zirconium fluoride. The chains of the polymers create the cohesion between the chemically bound iron fluoride, the structural parts, the primary parts, and the sliding parts. The more greatly the permanent mold is heated and thus the layer, the longer the polymer chains become, so that the elasticity of the layer increases with rising temperature. The polymers used as taught by the invention polymerize at about 200° C. and have a vitrification point of about 830° C. Liquid aluminum has a temperature of about 730° C. and therefore does not come close to the vitrification point of the polymers. An extremely stable system, highly suitable for the casting of aluminum materials, is therefore created as a layer structure.

The iron fluorides serve as an adhesive for the base material of the permanent mold and the primary parts are used in an advantageous manner to close the gaps between the structural parts, in order to thereby produce a very smooth surface. Adhesion of the liquid casting material is thus virtually almost impossible. The structural parts are present in a size of 80 nm to 200 nm and project as edges from the layer. Advantageously, the structural parts with a highly structured surface rip cracks in the oxide layer of the liquid aluminum and grind down the oxide skin, so that the oxide skin is ground into the smallest parts and thus is not present as a lattice defect in the structural composition of the cast part. An advantage of the structural parts employed as taught by the invention therefore is that the oxide skin is broken and ground down.

The sliding parts, present in the mold as boron nitrite, are much greater in size than the primary and structural parts. According to the invention, the structural parts with a percentage by weight of up to 10% in the liquid mold release agent form the largest part of the layer. The primary parts serve as a filling agent for the interspaces and thus function to smooth the layer. The sliding parts, present in a percentage by weight of up to 5%, are embedded finely distributed in the structural parts and also project at the surface of the layer. Because of the number of sliding parts, these do not form the largest surface of the layer, but are present finely distributed, so that they are used as sliding agents, on the one hand, during casting but primarily for the demolding of the permanent mold and to remove the cast part. The demolding is facilitated in an advantageous manner by the use of the layer of the invention, because, on the one hand, a very smooth surface at the layer is present due to the structural parts and the primary parts with a smoothing effect and simultaneously a lubricant is provided by the sliding parts.

Tests have shown that optimal formation of the layer is achieved by addition of a sodium hydroxide solution and/or a potassium hydroxide solution and/or aluminum chloride and establishing of a pH of 4 to 5.

According to the invention, the cold permanent mold is treated with the mold release agent by spraying of the mold release agent and heating of the permanent mold. Starting at a temperature of about 200° C., the zirconium fluoride polymerizes and a long-term stable layer forms on the surface of the permanent mold. A typical temperature for preheating during pressure casting is a temperature between 220° C. and 280° C., so that here an optimal temperature for the polymerization of the mold release agent is present. During low-pressure casting and squeeze casting, the preheating temperatures are still above 300° C., so that here as well formation of a layer is assured. The liquid metal with a temperature of about 720° C. to 730° C. during casting of aluminum is below the glass transition temperature. However, thixocasting is also above 200° C. and therefore the use of the layer of the invention in this method is also conceivable.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A mold release agent for preparing a layer on a permanent mold, comprising:

deionized water;

sodium hydroxide and/or potassium hydroxide and/or aluminum chloride;

a binder of zirconium fluoride, an amount of the binder being less than or equal to 5% by weight;

an amount of structural particles in the form of $Al_2O_3$ and/or $SiO_2$ and/or $TiO_2$ and/or $ZrO_2$ present in a size of 80 nm to 200 nm, the amount of the structural particles being less than or equal to 10% by weight;

an amount of primary particles in the form of $Al_2O_3$, $SiO_2$, ZnO, $ZrO_2$, CeO, $TiO_2$, and/or mica in a size of 2 nm to 80 nm, the amount of primary particles being less than or equal to 3% by weight; and an organic dispersant.

2. The mold release agent according to claim 1, wherein an amount of sliding particles in the form of boron nitrite and/or magnesium aluminum silicate and/or molybdenum disulfide in a size of 2 μm to 15 μm is present in the mold release agent.

3. The mold release agent according to claim 1, wherein an amount of sliding particles in the mold release agent is less than or equal to 5% by weight.

4. The mold release agent according to claim 1, wherein the primary particles are present in an amount between 1% by weight and 3% by weight.

5. The mold release agent according to claim 1, wherein said organic dispersant is gelatin.

* * * * *